US005319811A

United States Patent [19]

Hauri

[11] Patent Number: 5,319,811

[45] Date of Patent: Jun. 14, 1994

[54] CLOSET SEAT FOR A WATER CLOSET AS WELL AS AN APPARATUS FOR CLEANING THE POSTERIOR ON A WATER CLOSET HAVING A SEAT

[76] Inventor: Peter J. Hauri, Sälistrasse 20, CH-6005 Luzern, Switzerland

[21] Appl. No.: 719,571

[22] PCT Filed: Oct. 19, 1990

[86] PCT No.: PCT/CH90/00245

§ 371 Date: Jun. 24, 1991

§ 102(e) Date: Jun. 24, 1991

[87] PCT Pub. No.: WO91/06718

PCT Pub. Date: May 16, 1991

[30] Foreign Application Priority Data

Oct. 25, 1989 [CH] Switzerland ..... 3856/89

[51] Int. Cl.[5] ..... A47K 3/22; A47K 7/08

[52] U.S. Cl. ..... 4/443; 4/448; 4/420.4

[58] Field of Search ..... 4/420.4, 420.2, 447, 4/448, 443, 223, 228.1, 420.1, 420.5, 444, 445, 446

[56] References Cited

U.S. PATENT DOCUMENTS

| | | | |
|---|---|---|---|
| 429,374 | 6/1890 | Charlesworth | 4/420.1 |
| 641,238 | 1/1900 | Ruthven | 4/223 |
| 2,875,450 | 3/1959 | Umann | 4/447 |
| 2,946,065 | 7/1960 | Smith | 4/223 |
| 3,247,524 | 4/1966 | Umann | 4/447 |
| 3,316,559 | 5/1967 | Ewing et al. | 4/223 |
| 3,545,015 | 12/1970 | Richardson et al. | 4/447 |
| 3,810,260 | 5/1974 | Lodi . | |
| 3,995,326 | 12/1976 | Umann | 4/447 |
| 4,094,018 | 6/1978 | Bemthin | 4/447 |
| 4,237,560 | 12/1980 | Riegelman et al. | 4/447 |
| 4,581,779 | 4/1986 | Matsui et al. | 4/420.4 |
| 4,761,837 | 8/1988 | Takeda | 4/420.4 |

FOREIGN PATENT DOCUMENTS

| | | | |
|---|---|---|---|
| 125314 | 11/1984 | European Pat. Off. . | |
| 2809622 | 9/1980 | Fed. Rep. of Germany . | |
| 108736 | 4/1990 | Japan | 4/448 |

*Primary Examiner*—Henry J. Recla
*Assistant Examiner*—Charles R. Eloshway
*Attorney, Agent, or Firm*—Spencer, Frank & Schneider

[57] ABSTRACT

A water closet includes a toilet bowl, a toilet seat liftably and lowerably mounted on the toilet bowl, and an apparatus supported adjacent the toilet seat for the personal hygiene of the occupant of the water closet. The apparatus comprises a tank for storing water therein; and an air pump connected with the tank for introducing compressed air into the tank to place a volume thereof under pneumatic pressure. The air pump includes an actuating member for operating the air pump. The apparatus further has a spraying device connected to the tank and supported in a zone of the toilet seat for discharging, from the tank, water driven by the pneumatic pressure to clean the posterior of the occupant. A valve is connected between the tank and the spraying device. The valve has a closed position in which water is prevented from being discharged by the spraying device and an open position in which water is discharged from the spraying device.

10 Claims, 7 Drawing Sheets

CLOSET SEAT FOR A WATER CLOSET AS WELL AS AN APPARATUS FOR CLEANING THE POSTERIOR ON A WATER CLOSET HAVING A SEAT

BACKGROUND OF THE INVENTION

The present invention relates to a closet seat for a water closet for the personal hygiene and to a device for cleaning the posterior on a water closet having a seat.

Water closets by which after flushing the toilet, the posterior, or respectively, the anal region of a person sitting on the closet are cleaned by means of a water jet and subsequently dried by means of warm air are known. First and foremost are known water closets with fixed installations where necessary systems for pump, water supply lines and warm air are integral component parts of toilet flush tank, closet seat and the closet bowl for the purpose of a compact type of construction.

Such closets are found above all in hospitals, sanatoria and homes for the aged, but less so, however, in private households. On the one hand these closets are expensive to purchase and on the other hand upon an eventual later change over, the whole closet installation has to be replaced directly because of the manner of construction, which requires extensive constructional measures.

For this reason, the demand for a simpler closet system such as this arose wherewith existing closets could be reequipped. Also concerning this, several systems are known. Thus DE-OS-31,34,693 specifies a douche arrangement as accessory apparatus having a water closet which is insertable in the toilet flush tank.

From DE-OS-28,09,622 is known among other things, a warming of the flushing water, nozzles capable of being swivelled under pressure as well as a warm air blower being provided.

On the other hand, EP-A-0,275,492 shows how, for example, the seat ring can be used as a water tank having several subdivisions for supplying spray water to a nozzle system.

DE-OS-21,62,154 also shows how a hygienic douche unit of the type here in question having a pump system separated from the existing installation can be installed.

DE-PS-35,46,176 specifies a transportable bidet having a flushing arrangement of the type here in question, the whole being thereby, moreover, battery-driven, so that independence of the electric mains is also attained.

All the afore-described closet systems can perfectly well be installed onto existing closets without new water supply lines or electric connections having to be installed. Nevertheless, however, in part very extensive modifications and/or installations on the water closet itself continue to be necessary which, for example, can hardly be carried out by a private person. Furthermore, the specified systems are to a great extent not usable if, for example, the toilet flush tank is concealed or, as is customary in old buildings, is arranged on the ceiling above the closet bowl.

Furthermore, from EP-A-0,051,982 is known how a hygienic douche is to be built up module-system-like. Although this system does not necessarily require the help of a sanitary plumber, However, on the one hand the construction is complicated and on the other hand not stable, that is, the nozzle arrangement can easily slip out of place on the edge of the closet bowl and thereby take an incorrect position.

SUMMARY OF THE INVENTION

It is thus an object of the present invention to provide a simple and inexpensive additional flushing system for water closets for cleaning the posterior which has a compact construction and is easily mounted onto an existing water closet by a private person.

This is achieved by the invention, according to which, briefly stated, the water closet includes a toilet bowl, a toilet seat liftably and lowerably mounted on the toilet bowl, and an apparatus supported adjacent the toilet seat for the personal hygiene of the occupant of the water closet. The apparatus comprises a tank for storing water therein; and an air pump connected with the tank for introducing compressed air into the tank to place a volume thereof under pneumatic pressure. The air pump includes an actuating member for operating the air pump. The apparatus further has a spraying device connected to the tank and supported in a zone of the toilet seat for discharging, from the tank, water driven by the pneumatic pressure to clean the posterior of the occupant. A valve is connected between the tank and the spraying device. The valve has a closed position in which water is prevented from being discharged by the spraying device and an open position in which water is discharged from the spraying device.

It is proposed that a storage tank or container for receiving water be arranged on the seat and detachably connected to the seat. This storage tank is on the one hand connectable via a valve arrangement to at least one air pump, likewise arranged detachably mounted on the seat, and on the other hand via another valve arrangement to the means for the spray-like discharge. The two valve arrangements are laid out in such a manner that they are to open only then when the container is arranged on the seat.

In this manner, for filling with water, the storage tank can be removed from the seat without the water which has been filled into the storage tank being able to escape therefrom.

Alternatively thereto, the storage tank for receiving water can be connected integrally to the seat, in which case filling means are provided on the storage tank for filling and/or adding more water.

The air pumps arranged in the toilet seat are preferably connected to the toilet seat in such a manner that by at least one tilting motion thereof they are operable upwardly and/or as well as downwardly of the toilet seat ring, which is pivotally supported on a seat holding portion which is detachably connected to the toilet bowl, and/or a positive pressure is capable of being generated in the storage tank by means of these pumps. The air pumps are preferably disposed is such a way that these are capable of being operated only as long as a sufficiently high pressure is attained in the storage tank. Thereafter these run preferably idle.

In accordance with a further specific embodiment, it is proposed that the toilet seat ring be held by restoring means which are provided on the conveying means and/or on at least the one pump, at a spacing from the seat holding portion, and that the seat ring be operatively connected to the conveying means and/or at least the one pump in such a way that upon a pressing of the seat ring, through the weight of a person seated on the seat ring, against the holding portion, the holding portion of the conveying means and/or at least the one pump are actuated in order to generate pressure in the tank or container and/or to force water to the means for the spray-like discharge.

It is, however, likewise possible to operate the air pumps manually or by foot.

In order that upon actuation of the conveying means and/or at least the one pump, the water storage tank is not placed immediately under pressure, it is proposed that a pressure chamber be disposed between the conveying means and/or at least the one pump and the tank or the container, being separated therefrom, for example, by means of a valve, and which by means of at least one pump is placed under pressure This variant embodiment can be of advantage for reasons of safety.

Furthermore, again for reasons of safety, at least the one pump is provided with a safety valve and/or a so-called rupture or safety disk. Thus can be ensured that a maximum permissible pressure in the tank or container and/or in the pressure chamber is not exceeded.

In addition to this, means capable of being released or unlocked again for locking and/or placing out of operation the conveying means and/or at least the one pump may be provided in order to render an actuation thereof, for example by the seat ring, impossible. Thus is a utilizing of the seat according to the invention possible without making use of the posterior cleaning and without inducing a build up of pressure by the pump.

The means for the spray-like discharge of water comprise preferably one swivelling spray arm having a spraying nozzle, the spray arm being supported capable of swiveling, prior to the spray-like discharge, out of an unoperated resting position, which is essentially not visible from above to a person using the water closet, into a spraying position wherein the cleaning of the posterior is made possible. This swivelling position ensures that when the spray arm is not in operation this cannot be soiled or damaged by objects inserted or thrown into the closet.

For example, a release organ or part can be provided adjacent to the toilet seat in order to release the supply of water out of the tank or the container to the means for the spray-like discharge. The release part can be a tipping lever or a push-button.

So as to avoid the storage tank having to be removed out of the seat after every flushing process in order to add more water, a suction motor can also be provided to draw off water out of a toilet flush tank and to convey this to the spray nozzle or to the tank or container on the seat. Since the flushing water in the toilet flush tank is in some cases stored over longer periods, possible soiling or even bacterial pollution cannot be excluded. In this case, the water drawn off by the suction motor is preferably passed through a filter, for example, an activated charcoal filter.

Since the water in the closet flush tank has a temperature in the region of approximately 10° C. to 20° C., an additional heating unit having a thermostat is provided preferably on the means for conveying water to the spray nozzle or in the storage tank or container on the closet seat in order to warm the water to essentially body temperature, that is, 37° C.

The suction motor and the additional heating unit may be either mains-operated, which, of course, necessitates an installation, or on the other hand be run by battery.

Further is proposed that means be provided on the toilet seat for storing and delivering at least one additive to the spray nozzle and/or to the storage tank. The additive may be, for example, a perfume, a disinfectant, a cleaning agent or cosmetic agent.

So that the air pump need not be operated by means of a manipulation, a drive unit, for example, may be provided for driving the air pump.

For reasons of hygiene, it is further proposed that the release part, the suction motor, the additional heating unit and/or at least one drive unit are capable of being actuated contact-free by means of sensors. The arrangement of the sensors can be such that upon a hand of the user of the water closet approaching the sensor, either one or several of the afore-mentioned motors and units are triggered.

In the place of a pump, an exchangeable pressure cartridge may also be provided.

Moreover, for drying the posterior after cleaning, a warm air unit may be provided on the toilet seat such as, for example, an electric dryer which is driven after the cleaning process.

The more complicated and refined the auxiliary units and motors arranged on the toilet seat are, the more advisable it is, especially with regard to operating reliability and safeguard against soiling, to arrange these in a compact container which, for example, is mounted or confined on the seat portion.

It is, however, also possible to design this container, containing additional units and motors, in such a manner that this may be removed from the supporting portion or that this may be arranged independent of the supporting portion. For this reason, it is proposed that in an apparatus for cleaning the posterior on a water closet having a toilet seat described according to the invention, a container be additionally provided which is as far as is possible independent, in which feed pump, filter and continuous flow heater are arranged. This additional container being connected via water supply lines which, on the one hand, draw off water out of the toilet flush tank and, on the other hand, convey the filtered and warmed water in the additional container to the toilet seat in order to arrive then at the spray nozzle.

DESCRIPTION OF THE PREFERRED EMBODIMENT

Figure 1:
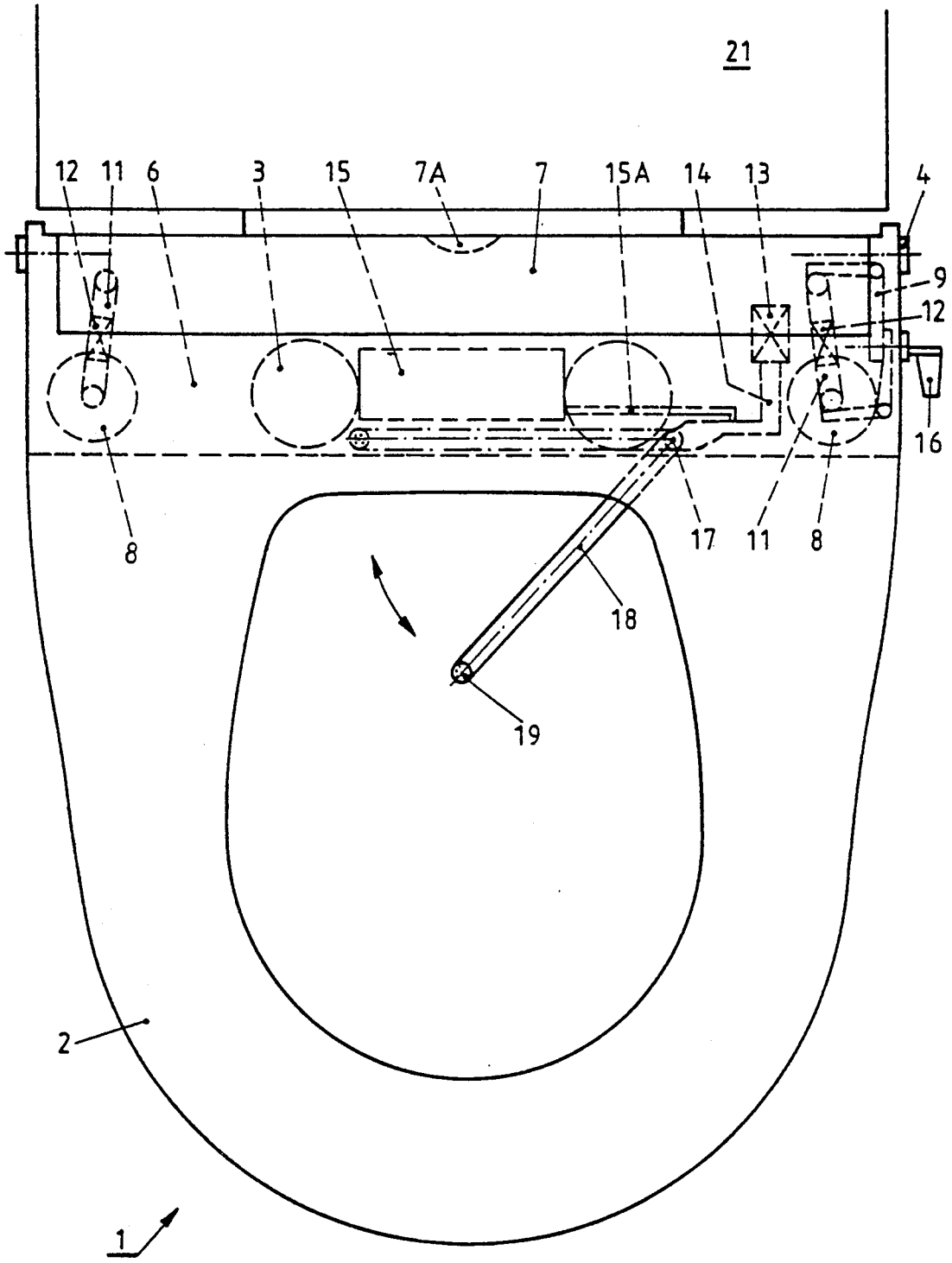
FIG. 1 is a closet seat according to the invention seen from above.
Figure 2:
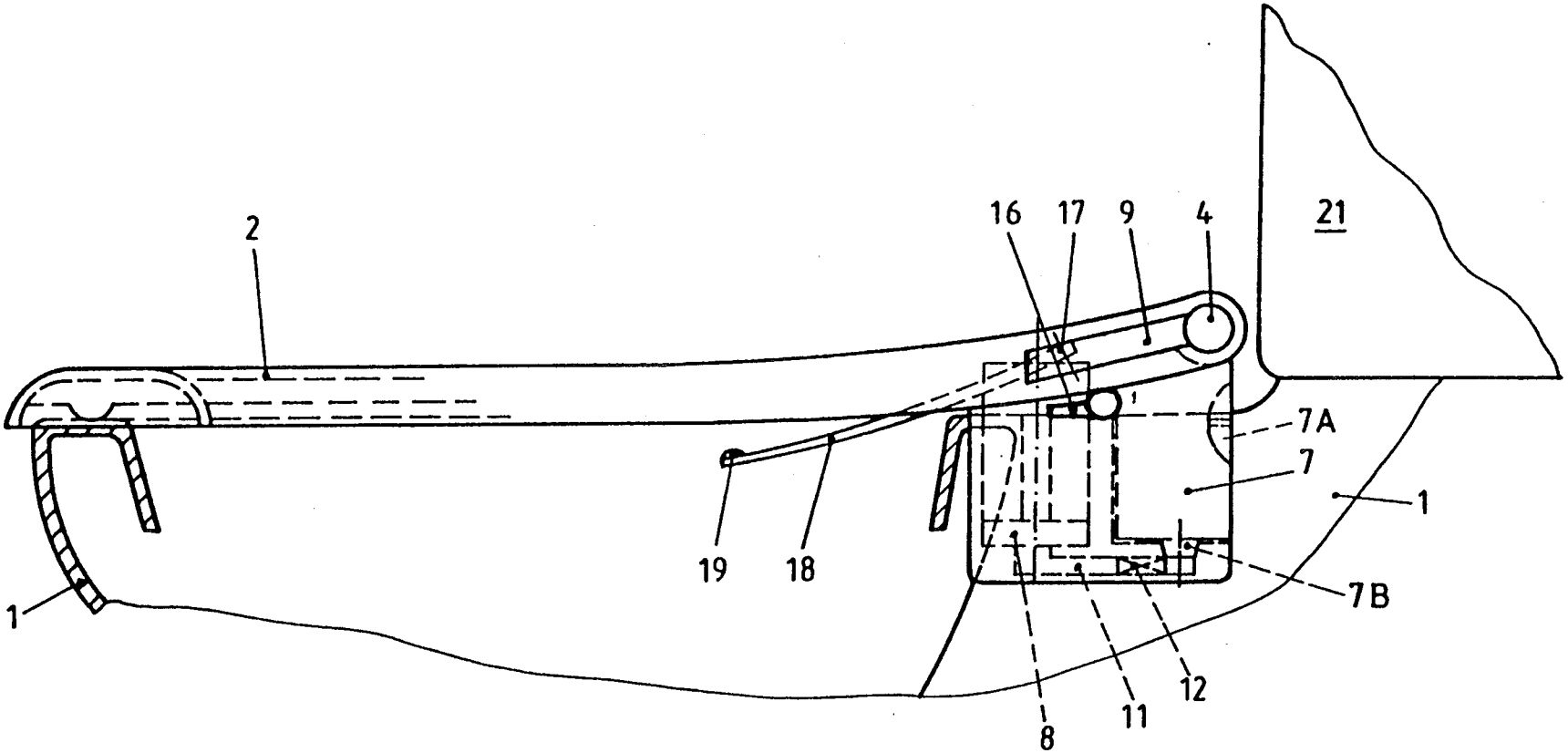
FIG. 2 is a lateral cross-sectional elevation of the water closet seat according to FIG. 1.

FIG. 1 shows a water closet seat according to the invention seen from above, and FIG. 2 the same seat according to the invention in a lateral cross-sectional elevation.

A water closet seat 2, 6 made of, for example, ceramics, is arranged on a closet bowl 1 and is detachably connected by means of an attachment 3 to the bowl. Such a seat according to the invention may, for example, be purchased in a department store and be disposed on a closet bowl in place of an existing conventional toilet seat. The attachment is preferably designed in such a universal manner that installation on all popular closet bowls is possible. Preferably, installation takes place by way of insertion means in order to simplify a later detachment, for example, for cleaning the toilet seat. The attachment can also be carried out by means of, for example, an eccentric disc, so that no screwing from above is necessary and a secure mounting of the toilet seat is nevertheless possible.

The toilet seat 2, 6 comprises on the rear side thereof a pivotal axle 4, by which means the actual seat portion or the seat ring 2 of the toilet seat is arranged pivotally supported on the seat holding portion 6 which is detachably connected to the toilet bowl by means of attachments 3. This holding portion 6 of the seat comprises further a water storage tank 7 which is detachably inserted in this holding portion 6. This water tank can, for example, be connected to the holding portion 6 via engageing members 7B (only one shown) in order to be held in a secure position.

In addition, two pumps 8 are arranged laterally in the holding portion 6, the pistons thereof being operatively connected t the tilting portion of the toilet seat 2 via a connection 9. The pumps 8 are connected to the storage tank 7 via supply lines 11 and valves 12. arm 18 via a valve 13 and water supply line 14, the spray arm 18 being pivotally supported on a rotating axle. On the point thereof, the spray arm 18 comprises a spay nozzle 19 for discharging water.

The operating manner of the toilet seat according to the invention will now be subsequently described.

Should a person now wish to use the water closet, the swivelling portion of the toilet seat 2 is first swivelled upward, so that the water tank 7 is freely accessible. This is now removed from the holding portion 6 and filled through a filling opening 7A with luke-warm water from, for example, the hand basin. Afterwards, the storage tank 7 is again inserted into the holding portion and the swivelling portion of the toilet seat 2 is swivelled downward onto the closet bowl 1. Thereby, the two pumps 8 are actuated and compressed air is pumped into the storage tank via the supply line 11 and through the valve 12, wherethrough the water in the storage tank is now placed under pressure.

The opening 7A of the storage tank 7 is preferably covered by a circular disk which is capable of being closed bayonet-like by turning and which withstands the generated pressure.

The storage tank 7 may, however, be connected integrally to the toilet seat 2, in which case the opening 7A of the storage tank is intended for the purpose of filling or adding more water directly on the toilet seat.

The arrangements of valves 12 are moreover provided for the purpose that no water can enter the pumps 8 from the storage tank 7. The valves 12 thus act as check valves.

Should the user now wish to clean the anal region of the posterior, the release lever 16 is actuated, whereupon valve 13 is opened. The water now flows out of the storage tank 7 via the water supply line 14 to the spray arm 18, which is swivelled into the spraying position as a result of the water pressure.

Figure 3:
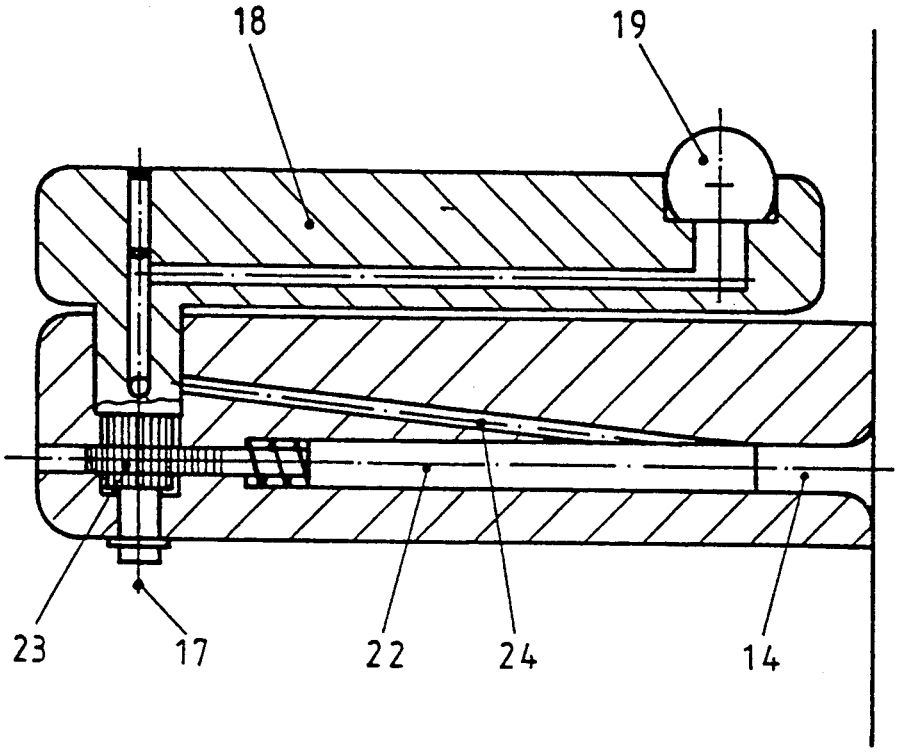
FIG. 3 is a schematic diagrammatic view illustrating the functioning of the spray arm of the closet seat according to FIGS. 1 and 2.

As soon as the spray arm 18 is in the spraying position, the passage to the spray arm is freed, as is illustrated in FIG. 3 in more detail, and the water thus reaches via the nozzle 19 the posterior region of the user to be cleaned.

The operating manner of the swivelling motion of the spray arm is illustrated in more detail in FIG. 3. Water is conducted under pressure from the water supply line 14 against a piston 22 which acts, as a result of this pressure, on a cogwheel-like "pinion" in order to thus swivel the swivelling spray arm 18 into the spraying position. If the piston is now pressed sufficiently hard against the pinion, the bridging supply line 24 becomes free, whereby water from the supply line 14 can now enter the spray arm 18 and the nozzle 19.

For the purpose of delivering cosmetic agent, an inlet from a feed pipe 15A, ,or example, can be provided on the supply line 14, out of which the cosmetic agent is delivered in measured quantities from a storage chamber 15 to the water flowing through the supply line 14.

Figure 4:
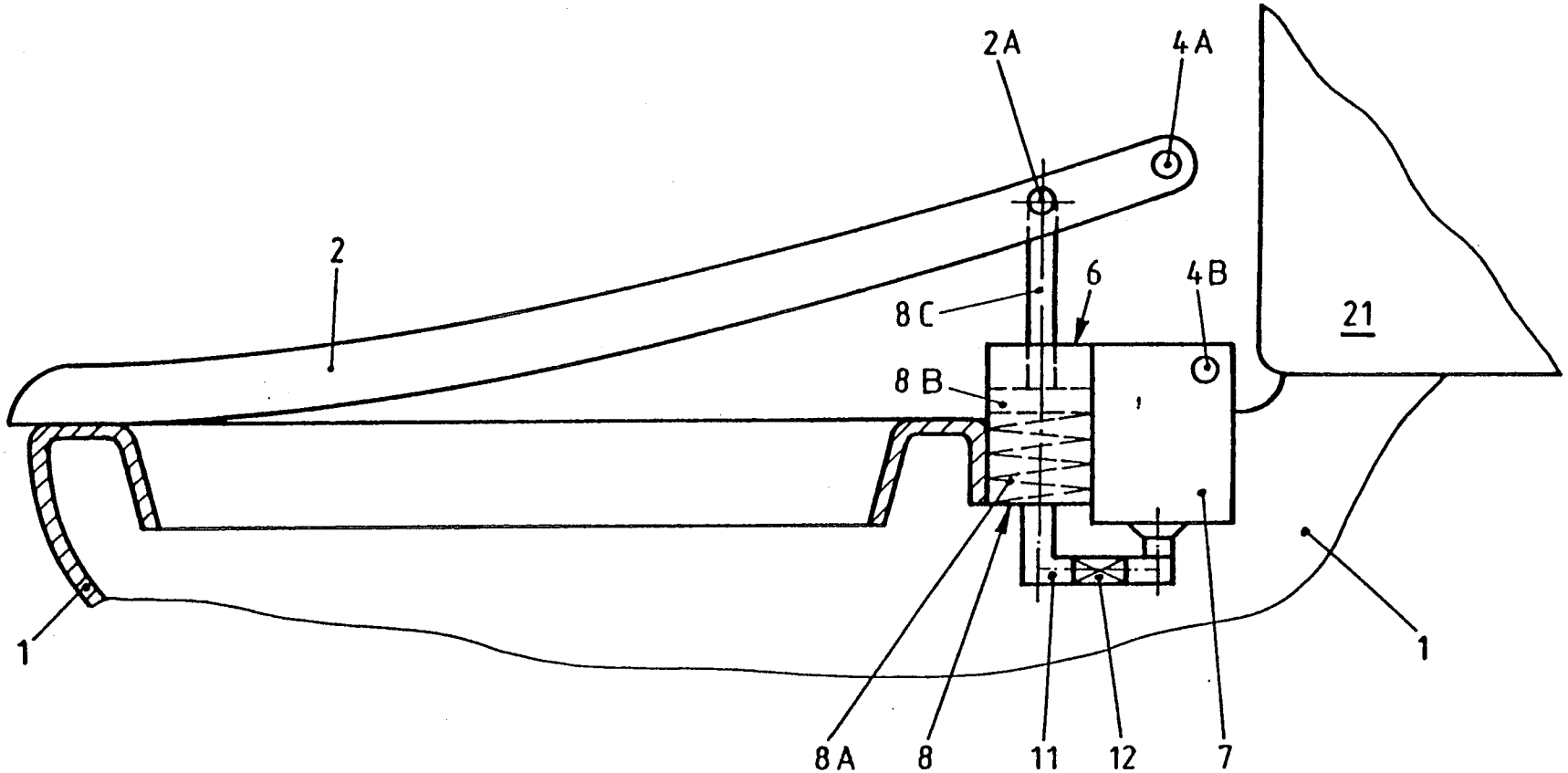
FIG. 4 is a longitudinal side elevation of another variant embodiment of a seat.

In FIG. 4, a further variant embodiment of a seat ring according to the invention is illustrated in longitudinal side elevation.

In this variant embodiment, the seat ring 2 is capable of being raised at least a distance from the holding portion, since, for example, the pivot connection 4A, 4B is detachable. The two pumps 8 (only one of which is visible) each comprises further, for example, a restoring spring 8A, each of which acts on the piston disc 8B and forces this upward into unoperated position. A piston rod 8C connected to the piston disc 8B by means of a hinge 2A is rotatable with the seat ring 2, this being raised from the holding portion and/or partially from the closet bowl at the restoring position of the pump.

If a person now sits on the seat ring 2, the seat ring is lowered onto the closet bowl 1 under the body weight, whereupon the pumps 8 are activated and air is pressed via supply line 11, valve 12 into the storage tank 7. The subsequent process for cleaning the posterior occurs analogous to that written in regard to FIGS. 1 and 2. The representation of the elements necessary for this purpose was dispensed with in FIG. 4 for reasons of clarity.

When the person finally stands up again, the toilet seat 2 again is driven upwards under the effect of the spring 8A. If desired, the seat ring 2 may, however, also be engaged on the holding portion by means of the pivot connection 4A, 4B, wherethrough the seat ring is no longer raised from the closet bowl 1.

Figure 5:
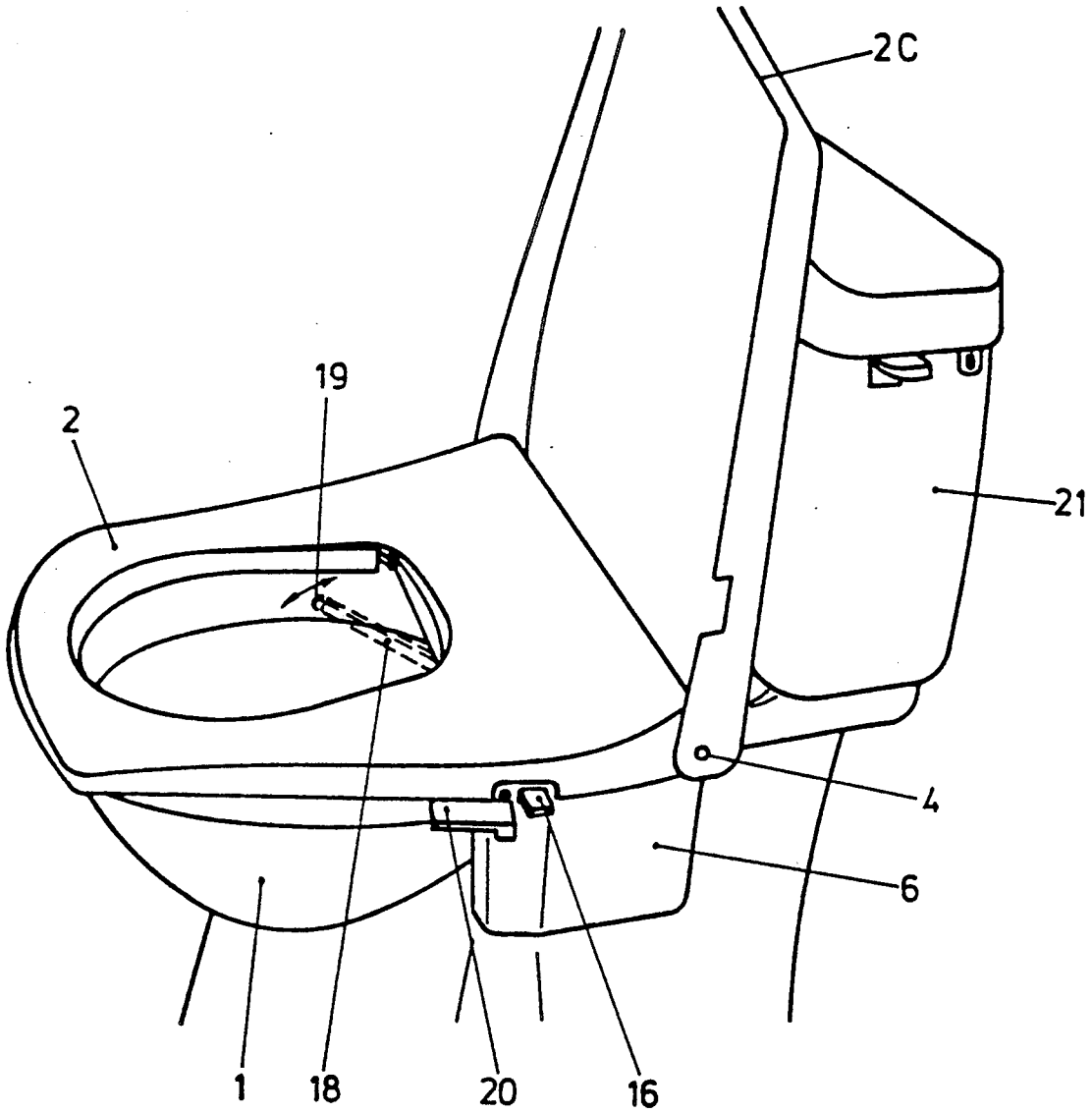
FIG. 5 is a perspective view of the arrangement of a water closet seat according to the invention on a water closet.

In FIG. 5, the arrangement of a toilet seat according to the invention on a water closet is represented in perspective for the better understanding thereof. The toilet seat 2 with the appropriate cover 2C are arranged on the closet bowl 1, whereby the pumps for generating the positive pressure are disposed in the holding portion 6, arranged laterally and not visible. The release lever 16 is, however, visible, by which means the discharge of water through the swivelling spray arm 18 and the nozzle 19 can be effected. In the embodiment according to FIG. 5, a lever 20 is further provided by means of which the spray arm is, for example, mechanically operable, intended as an alternative to hydraulic operation, as described especially with regard to FIG. 3.

Possible is also, naturally, to dispense with the lever 16 and to integrate the release in the mechanical operation of the spray arm by the lever 20 in such a manner that this then results when the spay arm is swivelled out completely.

The water flush tank 21 is disposed rearward to the toilet bowl 1 and is in unchanged manner operable for flushing the closet.

In addition, it is also possible, for example, that one of the two represented levers 16 and 20 also serves the purpose of locking the two pumps in such a manner that they are not actuated upon a folding down of the seat 2. This is necessary, for example, when a pressure build-up in the tank or the pressure chamber is to be prevented when the posterior douche is not in use. This locking mechanism may, for example, also be automatically coupled to the refilling opening 7A of the tank or the tank itself in such a manner that for the actuation of the pumps, these are only unlockable when water has been filled into the tank.

Figure 6:
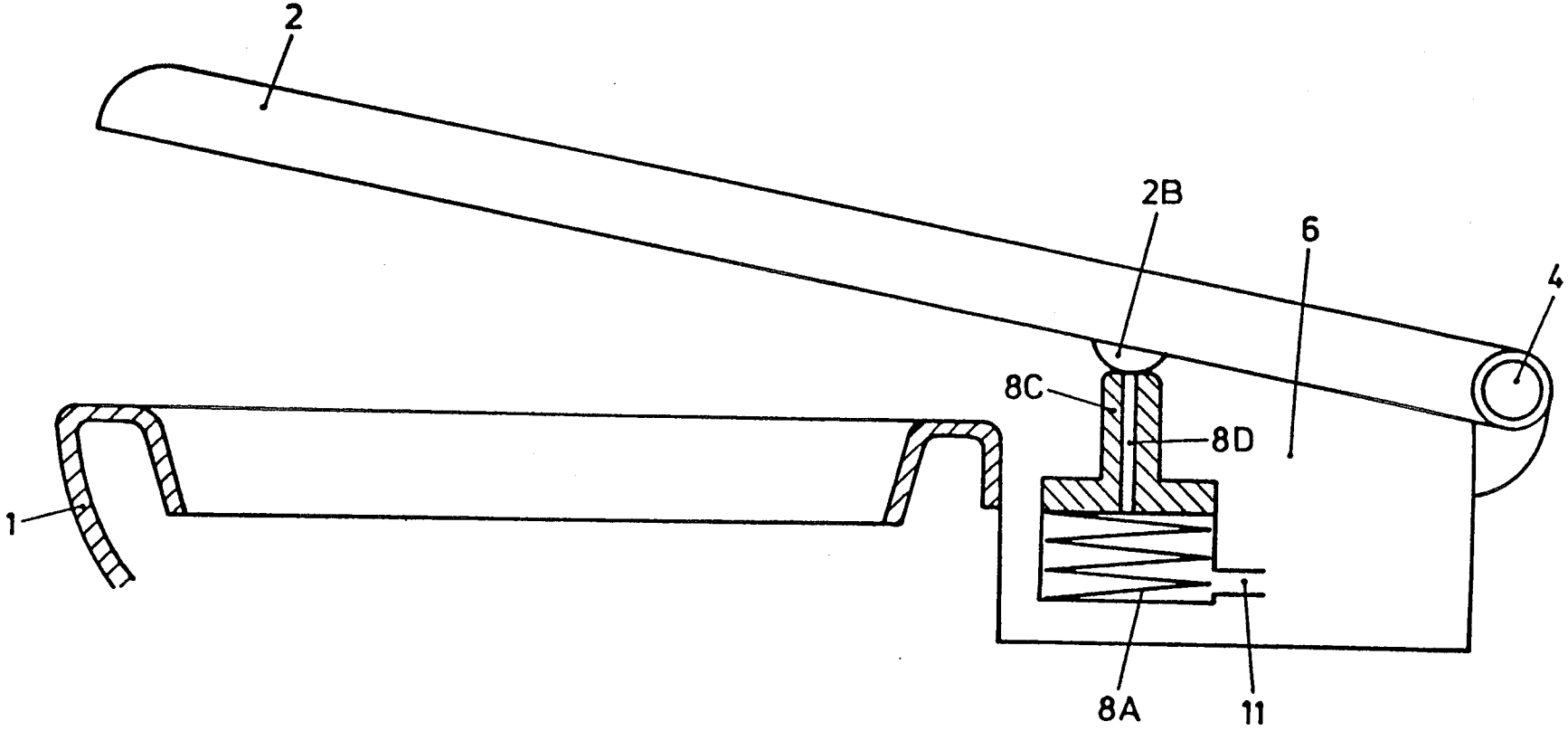
FIG. 6 is a schematic longitudinal view of a development of a pump modified with regard to technical safety.

In FIG. 6, the development of a pump 8 with regard to technical safety is represented in longitudinal view and by means of which an excessive maximum permissible pressure in the storage tank 7 is to be prevented, which might, for example, lead to a bursting of the storage tank. A bulge or rounded projection 2B is disposed on the toilet seat 2 at the place of contact with the piston rod 8C by means of which a vent 8D is closed or covered.

If the closet seat 2 is now pressed downwardly, the pinion rod 8C is actuated against the pressure of the spring 8A and a positive pressure is generated in the storage tank (not represented) via the supply line 11. However, if the water discharge is not actuated and the toilet seat 2 is again lifted upwardly, so the pressure escapes via the opening 8D since the projection 2B no longer rests tightly on the piston rod 8C. Thereby an excessive pressure generated by a renewed downward pressing of the toilet seat 2 can be prevented.

In accordance with a further variant embodiment (not represented) in respect of technical safety, a pressure chamber may be disposed between the pump and the storage tank in which, upon actuation of the pump, the positive pressure is collected and not passed immediately on to the storage tank. The positive pressure is only transferred to the storage tank upon actuation of the release button 16, wherethrough the water is driven out via the spay arm and the nozzle.

In accordance with a further alternative, in order not to have to refill the storage tank manually, it is, of course, possible to dispose a suction motor in the storage tank 7 to draw off war out of the toilet flush tank 21, in which case an activated charcoal filter is preferably provided in order to clean the water drawn off out of the toilet flush tank prior to entry in the storage tank 7.

It is also possible to operate the pumps 8 by means of a drive unit, so that the pivotable portion of the the toilet seat is not required to be lifted upwardly and downwardly for the actuation of the pumps. It is further possible to activate the pumps 8 by hand or foot or by means of an exchangeable pressure cartridge.

Figure 7:
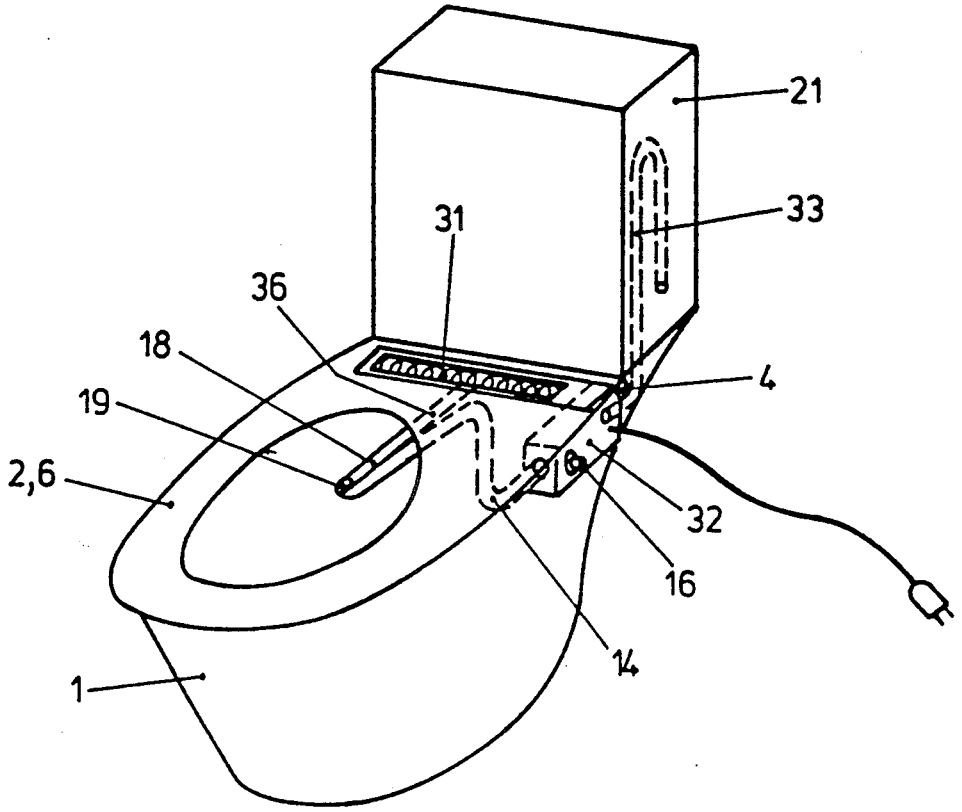
FIG. 7 is another toilet seat according to the invention provided with additional units and motors.

In FIG. 7, a further development of the closet seat according to the invention as defined in FIGS. 1 and 2 is represented perspectively schematically. Again, a toilet seat 2 is provided on a closet bowl 1 on which a swivelling spray arm 18 having a nozzle 19 is provided. In place of the storage tank, a warm air unit or dryer 31 is now disposed on the rear side of the toilet seat 2 and is connected to the spray arm 18 via an air supply line 36.

Since there now exists no space to dispose the air pump, additional units or a suction motor at the rear of the toilet seat due to the disposal of the dryer 31, an additional container 32 is provided which, for example, is arranged laterally hanging on the seat holding portion 6. The additional container 32 comprises a feed pump, filter means and a heating unit of known type, the detailed representation of which has been dispensed with in FIG. 7. The additional container 32 is connected by a suction line 33 to the inside of the toilet flush tank 21 and to the supply line 14 on the toilet seat 2, 6 via a connection on the container.

If a person using the toilet now wishes to clean his posterior, he can actuate the release button 16 on the container 32 which is, for example, provided with sensors, so that the actuation can ensue contact-free. Now water is drawn off out of the toilet flush tank 21 via the line 33 through the feed pump in the additional tank 32, passed through filter means and a continuous flow heater and, via the line 14, conveyed to the spray arm 18 and the nozzle 19, wherewith the cleaning of the posterior can take place.

After cleaning has been carried out, the dryer 31 is run, which passes warm air via the line 36 to the spray arm 18 also, which then blows the warm air, also via a nozzle, for example, to the region of the posterior to be dried.

After the toilet has been used several times, it is possible to remove the toilet seat 2 from the seat holding portion 6 by disengaging at the axle 4 and to clean this in a bathtub, for example. The container 32 and the dryer 31 remain with the holding portion 6 on the closet bowl 1.

Figure 8:
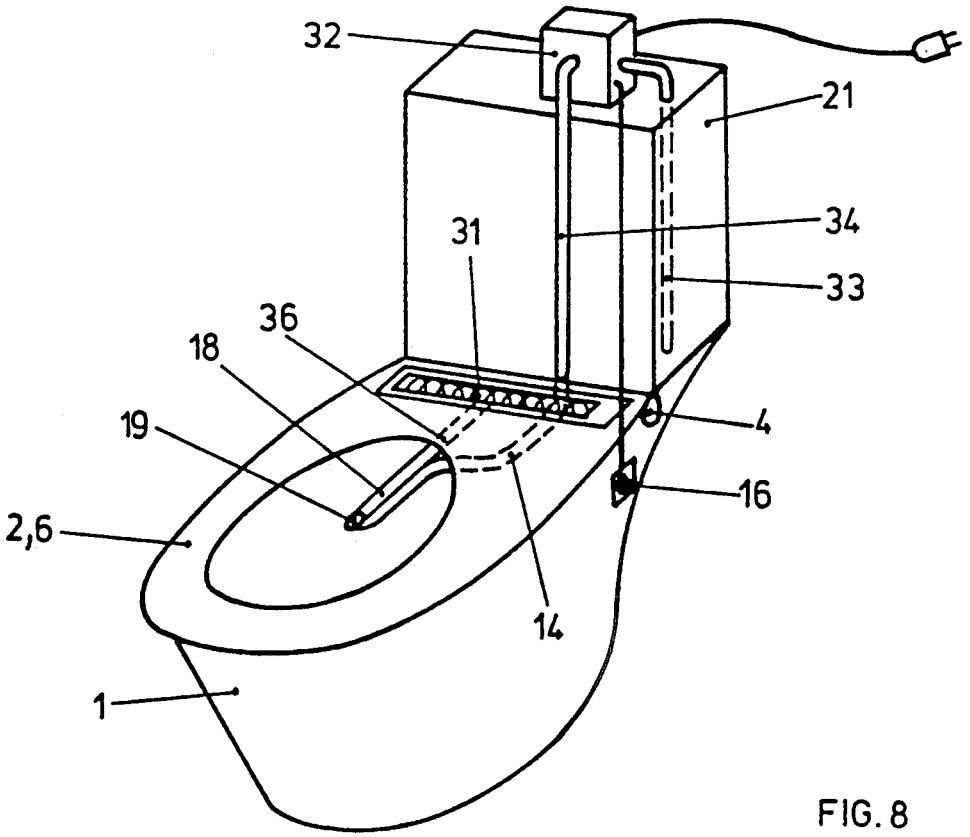
FIG. 8 is a further developed variant embodiment the water closet seat having additional units.

If desired or necessary owing to the size of the pump, the filter and the heating, the additional container 32 may also be separately constructed, as represented in FIG. 8, and disposed, for example, on the toilet flush tank. In this case, the additional container is to be connected via a line 34 to the feed line 14 and a separate release lever 16 is to be disposed on the toilet seat.

The variant embodiments of a closet seat according to the invention represented by way of example in FIGS. 1 through 8 are, of course, capable of being varied and modified in any manner that is desired; essential in this connection is that the toilet seat comprising the apparatus for cleaning the posterior can be detachably attached to the closet bowl.

Hence, the pumps represented in the figures may be adapted in any manner desired to meet requirements or developed in such a manner that a required quantity of water per actuating process can be driven out. The pumps may have, for example, an elliptical profile, so that disposed lengthwise adjacent to the closet bowl, a large stroke or press volume can be generated without requiring great space. It is also possible, for example, to provide devices on the toilet seat by which means the water level and if necessary also the level of additives and essences can be made visible.

I claim:

1. In a water closet including a toilet bowl, a toilet seat liftably and lowerably mounted on the toilet bowl, and an apparatus supported adjacent the toilet seat for the personal hygiene of the occupant of the water closet; the improvement wherein said apparatus comprises (a) a tank for storing water therein;

(b) an air pump connected with said tank for introducing compressed air into said tank to place a volume thereof under pneumatic pressure; said air pump including an actuating member for operating said air pump, wherein said actuating member is situated in a motion path of said toilet seat for actuating said air pump by said toilet seat upon motion thereof;

(c) a spraying device connected to said tank and supported in a zone of said toilet seat for discharging, from said tank, water driven by the pneumatic pressure to clean the posterior of the occupant; and (d) a valve connected between said tank and said spraying device; said valve having a closed position in which water is prevented from being discharged by said spraying device and an open position in which water is discharged from said spraying device.

2. The water closet as defined in claim 1, further comprising a check valve connected between said air pump and said tank for preventing water from flowing from said tank into said air pump.

3. The water closet as defined in claim 1, further comprising a safety valve operatively connected to said tank to release therefrom a pressure above a maximum permissible pressure.

4. The water closet as defined in claim 1, further comprising means for moving said valve into one of said positions by a body part of the occupant.

5. The water closet as defined in claim 1, further comprising an additional reservoir for storing an additive; said additional reservoir being connected to said tank.

6. The water closet as defined in claim 1, further comprising locking means for preventing operation of said actuating member.

7. The water closet as defined in claim 1, wherein said actuating member is connected to said toilet seat; further wherein said air pump comprises a piston and a return spring urging said piston into a starting position; said piston being connected to said actuating member; said return spring urging said toilet seat into a raised position; said air pump being actuated by an occupant of the water toilet upon depressing said toilet seat.

8. The water closet as defined in claim 7, wherein said actuating member is a piston rod affixed to said piston.

9. The water closet as defined in claim 1, wherein said spraying device comprises a pivotally supported spraying arm terminating in a spraying nozzle; said spraying arm having an inoperative position in which the spraying arm is withdrawn from a region surrounded by said toilet seat and an operating position in which the spraying arm is situated in said region and displacing means for moving said spraying arm from said withdrawn position into said operating position.

10. The water closet as defined in claim 9, wherein said displacing means includes means for responding to a pressure of water released from said tank by placing said valve into said open position.

* * * * *